US008333135B2

(12) United States Patent
Del Fabro

(10) Patent No.: US 8,333,135 B2
(45) Date of Patent: Dec. 18, 2012

(54) FEED DEVICE FOR METAL BARS, AND RELATIVE METHOD OF FEED

(75) Inventor: Giorgio Del Fabro, Udine (IT)

(73) Assignee: M.E.P. Macchine Elettroniche, Reana Del Rojale (IT)

( * ) Notice: Subject to any disclaimer, the term of this patent is extended or adjusted under 35 U.S.C. 154(b) by 692 days.

(21) Appl. No.: 12/594,736

(22) PCT Filed: Apr. 3, 2008

(86) PCT No.: PCT/EP2008/054058

§ 371 (c)(1),
(2), (4) Date: Oct. 5, 2009

(87) PCT Pub. No.: WO2008/122588

PCT Pub. Date: Oct. 16, 2008

(65) Prior Publication Data

US 2010/0080674 A1 Apr. 1, 2010

(30) Foreign Application Priority Data

Apr. 6, 2007 (IT) ..... UD2007A0065

(51) Int. Cl.
*B23B 13/12* (2006.01)
*B23B 13/00* (2006.01)

(52) U.S. Cl. ..... 82/124; 82/125; 82/127

(58) Field of Classification Search ..... 82/124, 82/125, 126, 127; 414/14, 16, 17, 20
See application file for complete search history.

(56) References Cited

U.S. PATENT DOCUMENTS

| | | | | | |
|---|---|---|---|---|---|
| 1,804,154 | A * | 5/1931 | Cowley et al. | 198/354 |
| 2,714,832 | A * | 8/1955 | Seed et al. | 86/45 |
| 3,094,224 | A * | 6/1963 | Mead | 414/14 |
| 3,768,626 | A * | 10/1973 | Vossler et al. | 198/398 |
| 4,088,230 | A * | 5/1978 | Doe et al. | 414/15 |
| 4,421,446 | A * | 12/1983 | Leon et al. | 414/17 |
| 4,998,455 | A * | 3/1991 | Jauch | 82/127 |
| 5,186,086 | A * | 2/1993 | Wetherill et al. | 82/124 |
| 6,302,003 | B1 * | 10/2001 | Haller et al. | 82/1.11 |
| 2003/0101854 | A1 * | 6/2003 | Cucchi | 82/127 |
| 2009/0191041 | A1 | 7/2009 | Del Fabro et al. | |

FOREIGN PATENT DOCUMENTS

| | | | |
|---|---|---|---|
| DE | 2 417 851 | | 10/1974 |
| DE | 7916259 | A1 | 9/1979 |
| EP | 0 790 086 | A2 | 8/1997 |
| EP | 1 845 040 | A1 | 10/2007 |
| IT | UD2006A000096 | A1 | 10/2007 |
| WO | 2005/080021 | A1 | 9/2005 |

* cited by examiner

*Primary Examiner* — Will Fridie, Jr.
(74) *Attorney, Agent, or Firm* — Novak Druce + Quigg, LLP

(57) ABSTRACT

A device and method to feed metal bars associated with a work machine including at least a drawing member for the metal bars. The device includes loading members to load one or more metal bars to the work machine, and one or more containing members in which the metal bars are disposed in respective bundles. The device also includes deflector members disposed downstream of the containing members and upstream of the drawing member, and movable laterally in independent manner with respect to the containing members, so as to be able to condition the position of at least a head portion of each of the metal bars picked up, relative to their lying position in the containing members, so as to displace them sideways one by one, or in groups, with respect to a nominal axis (X) in which the metal bars lie stationary in the respective containing member.

11 Claims, 2 Drawing Sheets

FEED DEVICE FOR METAL BARS, AND RELATIVE METHOD OF FEED

This application is a §371 National Stage Application of International Application No. PCT/EP2008/054058, filed on 3 Apr. 2008, claiming the priority of Italian Patent Application No. UD2007A000065 filed on 6 Apr. 2007.

FIELD OF THE INVENTION

The present invention concerns a device and the relative method for feeding metal bars to a work machine, such as for example a stirruping machine, bending machine, shaping machine, binding machine or other type of analogous or similar machine. In particular, the feed device according to the invention is suitable to pick up, in a substantially automatic manner, at least one bar at a time from a bundle of bars disposed in a container, keeping said container stationary and with a nominal axis constantly aligned with an axis of a drawing unit of the work machine, irrespective of the relative pick-up position of the bars with respect to the container.

BACKGROUND OF THE INVENTION

Work machines for metal bars are known, which work one or more bars at a time, for example to make shaped pieces for the building trade or other type of product. Machines that use metal bars normally have a plurality of containers, mounted and/or made on a feed trolley in which respective bundles of bars are prepared, of different diameter between one container and another, from which the bars to be sent to the machine are picked up on each occasion.

The operation of picking up and extracting the individual bars from the bundle is often very difficult, because the bars, which can even reach lengths of 12 meters and more, are disposed haphazard, entangled and twisted with each other.

From WO2005/080021, in the name of the present Applicant, a feed device is known, comprising a first magnetic means which separates from a bundle a head segment of a plurality of bars and disposes said head segments on a plane raised with respect to the bundle, and a second magnetic means which picks up from the first magnetic means one bar at a time from the plurality of bars and discharges it into a desired release position, in particular into a drawing unit of the work machine, so that the bar can be sent for working.

The containers present on the trolley are substantially triangular in shape, with a progressive reduction in width between the top and the bottom. Therefore, as the bars are gradually picked up, the position of the remaining bars is modified with respect to the axis of the drawing unit, and there is no longer any reciprocal alignment.

It is also known, from the Italian patent application IT-A-UD2006A000096, also in the name of the present Applicant, that in order to facilitate the operations of picking up the metal bars from the bundle, the feed trolley is translated laterally, on each occasion, before the pick-up, so as to position the container containing the bundle of bars with respect to the first magnetic means, according to the level of fullness of the container and the relative position of the bars to be picked up inside the container. In this way, a desired pick-up order of the bars is guaranteed.

Normally, however, the feed trolley must be re-positioned after pick-up, in a substantial condition of alignment, at least with a determinate nominal axis with the axis of the drawing unit for the whole duration of the operation to load the bars, so as to facilitate the complete extraction thereof from the relative bundle.

This aligned positioning of the container with the drawing unit does not always coincide with the loading position of the new bars and, therefore, at the end of the complete extraction of the bars, the trolley must again be translated laterally in order to allow the first magnetic means to begin gripping again according to the established pick-up order.

The first magnetic means must therefore wait for the complete extraction of the bars from the bundle before picking up new bars, both to prevent uncontrolled flexions of the bars during extraction, and also due to the risk of knocking the bars being extracted.

Purpose of the present invention is therefore to achieve a device, and perfect a method, for feeding metal bars which will allow to optimize the feed of the bars, reducing operating times between one load and the next, irrespective of their position in the container from which they are taken, and irrespective of the value of the state of fullness of said container.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a feed device for metal bars according to the present invention is associated with a work machine, and comprises loading means able to load one or more metal bars to the work machine, and containing means of the container type, made on a trolley, in which the metal bars are disposed in respective bundles.

According to a characteristic feature of the present invention, the feed device also comprises deflector means, disposed downstream of the containing means and upstream of the work machine, and movable at least laterally, in an independent manner with respect to the latter, in order to be able to condition the position of at least a head portion of the metal bars, on each occasion picked up, with respect to a nominal lying axis thereof in the containing means, so as to displace them sideways, one by one, or in groups, with respect to the axis of feed of the work machine, as they are gradually picked up from the specific containing means.

With the present invention, the metal bars to be picked up therefore have at least their head portion displaced sideways with respect to the axis of feed, irrespective of their relative position inside the loading means.

In this way, it is possible to carry out simultaneously both the complete extraction of the loaded bars, which always takes place substantially along the axis of feed of the machine, and also the picking up of new bars from the bundle, which takes place in a position displaced sideways with respect to said axis of feed, therefore without reciprocal interference.

The solution according to the present invention is even more advantageous in the common case where the containing means comprises one or more containers for the bundles which have a substantially triangular shape with a progressive reduction in width.

In this condition, the state of fullness of the container can always be monitored, according to the original weight of the bundle and the number of bars progressively extracted, so as to establish a desired pick-up order of the bars and to condition the positioning of the pick-up means.

With the present invention, the lateral movement of the deflector means can therefore be correlated to the progressive emptying of the container, so as to guarantee always the desired pick-up order of the bars and the correct reciprocal positioning of the pick-up means and the deflector means, according to the known position of the container.

Moreover, the lateral movement of the head portions of the bars determines an elastic deformation thereof which, once picked up and released by the loading means, tend to automatically return in alignment with the axis of feed of the machine, which facilitates the correct extraction from the bundle.

In a preferential form of embodiment, the deflector means comprises a slider movable laterally with respect to the containing means, in a direction transverse to the development of the metal bars, and on which one or more guide elements are provided which cooperate with the head portions of the bars in order to displace them laterally with respect to the axis of feed of the work machine.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
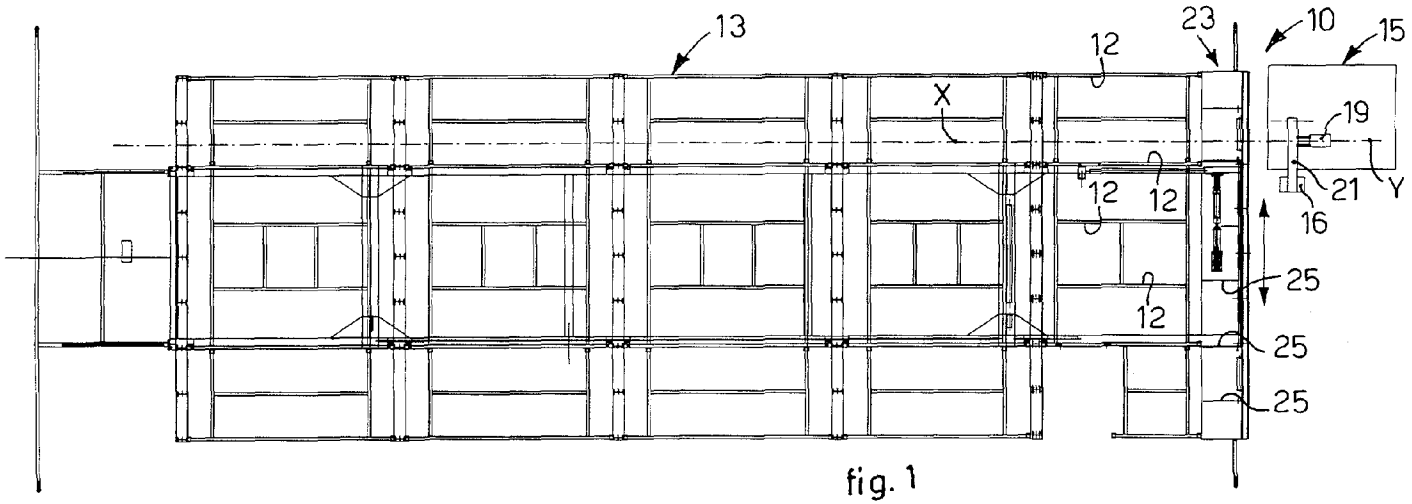
FIG. 1 is a schematic plane view of a feed device for metal bars according to the present invention.
Figure 2:
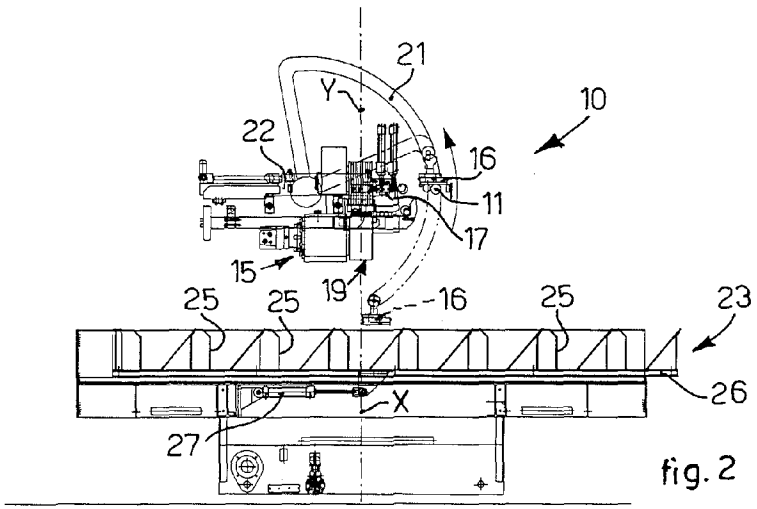
FIG. 2 is a schematic front view of the feed device in FIG. 1.
Figure 5:
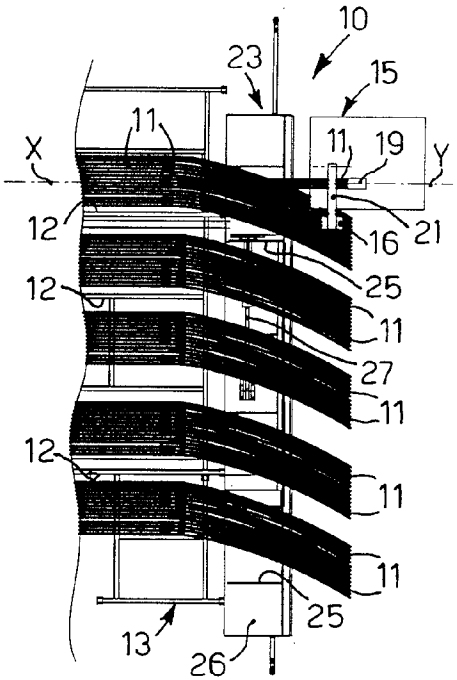
FIG. 5 is a schematic view from above of a third operating condition of the feed device in FIG. 1.
Figure 4:
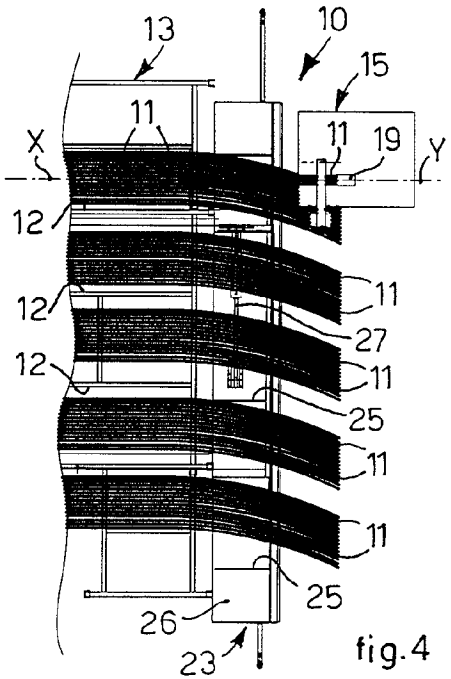
FIG. 4 is a schematic view from above of a second operating condition of the feed device in FIG. 1.
Figure 3:
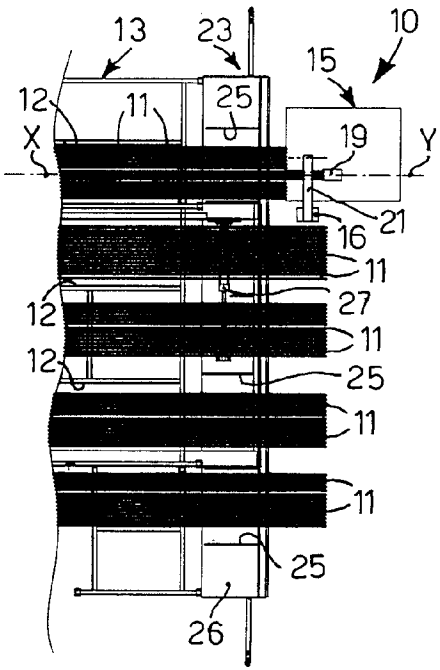
FIG. 3 is a schematic view from above of a first operating condition of the feed device in FIG. 1.

With reference to the attached drawings, a feed device 10 according to the present invention is shown, which is applied for loading one or more metal bars 11 at a time to a traditional work machine for said metal bars 11, such as stirruping machine, shaping machine, bending machine, binding machine or other type of analogous or similar machine, or also different.

The metal bars 11 are grouped together by diameter in bundles, each one disposed in a relative container 12 of a loading trolley 13 of the work machine. In this case, each container 12 has a cross section converging towards the bottom and asymmetrically, so as to promote the sliding of the metal bars 11 towards one side as they are progressively picked up.

The loading trolley 13 is selectively movable in a direction substantially transverse with respect to the development of the metal bars 11, by means of a movement member of a known type, for example on a track, so as to position the relative containers 12 on each occasion with a nominal longitudinal axis X, substantially median, substantially aligned with an axis of feed Y of the metal bars 11 into the work machine.

The feed device 10 is mounted in this case on a supporting frame 15 and comprises a first magnet 16 disposed advantageously during use in proximity with a head end of the bars 11, and able to pick up a certain number of metal bars 11 from the relative container 12, and a second magnet 17, with horizontal movement, which picks up a desired number of metal bars 11, normally one at a time, from the first magnet 16, in order to dispose them in cooperation with a known drawing member 19, for example with rollers, which feeds the metal bars 11 to the work machine, substantially along the axis of feed Y.

The first magnet 16 is mounted on an arm 21 associated with a first actuator 22, for example of the fluid-dynamic type, which makes it move, in this case in a substantially circular manner.

The feed device 10 also comprises a deflector member 23 mounted downstream of the containers 12 and upstream of the drawing member 19, provided with guide elements 25 disposed in extension of the containers 12, and conformed so as to contain at least the head ends of the metal bars 11.

Advantageously, the guide elements 25 have a cross section substantially equivalent to the containers 12, that is, conformed convergent towards the bottom.

The deflector member 23 also comprises a slider 26, in this case mounted sliding transversely on the head end of the loading trolley 13, and on which the guide elements 25 are fixed.

The slider 26 is selectively movable by means of a second actuator 27, mounted on the loading trolley 13.

In this way, the deflector member 23 is selectively movable independently with respect to the loading trolley 13, so it is possible to displace on each occasion the head portion of the metal bars 11, picked up laterally to the axis of feed Y, irrespective of their relative position inside the container 12 and with respect to the median axis X of the latter.

In particular, the movement of the deflector member 23 is commensurate with a pre-defined pick-up position of the metal bars 11, so as to keep a desired pick-up order of the bars 11.

The feed device 10 is associated with a command and control unit, not shown.

The command and control unit, according to the original weight of the bundle of metal bars 11 and the size of the metal bars 11 extracted, is able to calculate, with a good approximation, the state of fullness of the container 12, in order to correlate with said state the lateral movement of the deflector member 23, and hence of the head ends of the metal bars 11, with respect to the load effected by the magnets 16 and 17.

The method according to the present invention for feeding the metal bars 11 to the work machine is as follows.

First of all, a first set-up step is carried out in which, after having identified the container 12 containing the metal bars 11 to be loaded onto the work machine, the loading trolley 13 is commanded to move and take the container 12 with the relative median axis X substantially aligned with the axis of feed Y of the work machine.

According to a variant, the work machine is moved with respect to the loading trolley 13, so as to align the two axes X and Y.

In this first step, the state of fullness of the container 12 is also estimated, in terms of volume occupied, so as to establish the desired pick-up order of the metal bars 11.

Then a second step of deflection is started, in which the deflector member 23 displaces at least the heads of the metal bars 11 laterally to the axis of feed Y, by means of the corresponding guide element 25.

This lateral displacement is effected by means of the guide elements 25 of the deflector member 23 which, due to the movement imparted to them by the slider 26, displace the respective head ends of the metal bars 11 and take them to the relative pick-up position with respect to the first magnet 16.

The entity of the displacement imparted by the guide elements 25 is commensurate with the pick-up order of the metal bars 11. In this way, the first magnet 16 picks up the metal bars 11 from a determinate position in the bundle, according to the state of fullness of the container 12.

For example, in the case shown here, if the magnet 16 picks up some metal bars 11 on the right side of the container 12, the entity of the lateral movement imparted by the guide element 25 is only slight, whereas if metal bars 11 disposed in a central zone or on the left side of the container 12 have to be picked up, the entity of lateral movement is progressively greater.

After the heads of the metal bars 11 have been moved laterally, there is a loading step in which, in a substantially traditional manner, the first magnet 16 picks up one or more metal bars 11 from the relative bundle and lifts them to the height of the second magnet 17, so that the latter picks them up one by one in order to carry them, directly or indirectly, into cooperation with the drawing member 19.

The operation of the second magnet 17 is facilitated by the elastic return of the metal bars 11 which, from the laterally displaced position imparted by the deflector member 23, tend to return substantially aligned with the axis of feed Y.

With the present invention, simultaneously with the loading of the metal bars 11 into the drawing member 19 by the second magnet 17, we also have a new movement of the deflector member 23, so as to prepare, according to the desired pick-up order, new metal bars 11 to be picked up by the first magnet 16.

In this way, the first magnet 16 can pick up new metal bars 11, without interference with the tail ends of the metal bars 11 being extracted, at the same time as the metal bars 11 previously loaded finish being extracted.

It is clear, however, that modifications and/or additions of parts may be made to the device 10 and the method as described heretofore, without departing from the field and scope of the present invention.

For example, it comes within the field of the present invention to provide that the guide elements 25 have a different shape from that of the containers, but in any case suitable to displace the metal bars 11 laterally with respect to the axis of feed Y of the work machine.

It also comes within the field of the present invention to provide that the deflector member 23 is completely independent from the loading trolley 13, that is, with the slider 26 mounted sliding on a support detached from the loading trolley 13.

According to a variant, the deflector member 23 comprises only one guide element 25 able to cooperate, on each occasion, with the container 12 from which the metal bars 11 are picked up.

According to another variant, the device 10 comprises two deflector members 23 disposed on different segments of the bars 11 of the same bundle.

It is also clear that, although the present invention has been described with reference to specific examples, a person of skill in the art shall certainly be able to achieve many other equivalent forms of feed device for metal bars, and relative method of feed, having the characteristics as set forth in the claims and hence all coming within the field of protection defined thereby.

What is claimed is:

1. A feed device for metal bars associated with a work machine comprising at least a drawing member for said metal bars, said device comprising loading means able to load one or more of said metal bars to said work machine, and one or more longitudinal containing means in which said metal bars are disposed in respective bundles, wherein said container has a nominal longitudinal axis (X) and said drawing member defines an axis of feed (Y) of said metal bars into said work machine, the feed device also comprising deflector means disposed downstream of said containing means and upstream of said drawing member, and movable laterally in independent manner with respect to said containing means, so as to be able to move laterally a head portion of each of said metal bars picked up, relative to their lying position in said containing means, so as to displace the head portions sideways one by one, or in groups, with respect to said nominal axis (X) in which the metal bars lie stationary in the respective containing mean to position said head portion sideways with respect to said axis of feed (Y).

2. The feed device as in claim 1, wherein said deflector means comprises one or more guide elements conformed to cooperate at least with said head portions of said metal bars.

3. The feed device as in claim 2, wherein said containing means have a cross section converging towards the bottom, and wherein said guide elements are conformed in a manner corresponding to said containing means.

4. The feed device as in claim 2, wherein said deflector means comprises a slider element mounted sliding with respect to said containing means in a direction substantially transverse to the development of said metal bars, and on which said guide elements are mounted.

5. The feed device as in claim 4, wherein said containing means are mounted on a loading trolley movable transversely with respect to the development of said metal bars, said slider element is mounted sliding on said loading trolley and downstream of said containing means.

6. The feed device as in claim 5, wherein said deflector means also comprises an actuator member mounted on said loading trolley and able to selectively move said slider.

7. A method for feeding metal bars to a work machine comprising at least a drawing member for said metal bars, said method comprising at least a first set-up step in which longitudinal containing means for bundles of said metal bars are aligned with a nominal axis (X) thereof to an axis of feed (Y) of said drawing member, and a second loading step in which by means of loading means said metal bars are picked up from said containing means and loaded onto said drawing member, wherein said container has a nominal longitudinal axis (X) and said drawing member defines an axis of feed (Y) of said metal bars into said work machine, the method also comprising a third deflection step in which at least a head portion of each of said metal bars picked up is moved laterally by said deflector means disposed downstream of said containing means, so as to displace sideways, one by one or in groups, said head portions of said metal bars with respect to said nominal axis (X) in which they lie stationary in the respective containing mean, in order to position said head portion sideways with respect to said axis of feed (Y).

8. The method as in claim 7, providing at least a set-up step, in which according to the weight of the bundles and the parameters of size of said metal bars, the state of fullness of the relative containing mean is estimated, establishing a desired pick-up order of said metal bars, wherein said lateral movement of the head portions of said metal bars is effected in correlation to said progressive variation in the fullness of said containing mean.

9. The feed device as in claim 3, wherein said deflector means comprises a slider element mounted sliding with respect to said containing means in a direction substantially transverse to the development of said metal bars, and on which said guide elements are mounted.

10. The feed device as in claim 9, wherein said containing means are mounted on a loading trolley movable transversely with respect to the development of said metal bars, said slider element is mounted sliding on said loading trolley and downstream of said containing means.

11. The feed device as in claim 10, wherein said deflector means also comprises an actuator member mounted on said loading trolley and able to selectively move said slider.

* * * * *

UNITED STATES PATENT AND TRADEMARK OFFICE

CERTIFICATE OF CORRECTION

PATENT NO. : 8,333,135 B2
APPLICATION NO. : 12/594736
DATED : December 18, 2012
INVENTOR(S) : Del Fabro It is certified that error appears in the above-identified patent and that said Letters Patent is hereby corrected as shown below:

Title Page, item [73]
Assignee's name: change "M.E.P. Macchine Elettroniche" to --M.E.P. MACCHINE ELETTRONICHE PIEGATRICI SPA--

Signed and Sealed this
Twelfth Day of February, 2013

Teresa Stanek Rea
*Acting Director of the United States Patent and Trademark Office*